United States Patent [19]

Portilla

[11] Patent Number: 4,520,744

[45] Date of Patent: Jun. 4, 1985

[54] SEWING MACHINE WITH ARTICULATED TABLE ASSEMBLY

[76] Inventor: Mario Portilla, 1275 Bloomfield Ave., Fairfield, N.J. 07006

[21] Appl. No.: 629,995

[22] Filed: Jul. 12, 1984

[51] Int. Cl.[3] ..... D05B 57/30; D05B 73/04

[52] U.S. Cl. ..... 112/260; 108/20; 74/16

[58] Field of Search ..... 248/652, 646; 108/71, 108/112, 20, 21; 74/16; 112/260, 182

[56] References Cited

U.S. PATENT DOCUMENTS

| | | | |
|---|---|---|---|
| 2,583,735 | 1/1952 | Hayes | 112/260 X |
| 3,112,718 | 12/1963 | Bono | 112/260 X |
| 3,345,021 | 10/1967 | Gransten | 248/646 |

FOREIGN PATENT DOCUMENTS

| | | | |
|---|---|---|---|
| 435770 | 6/1925 | Fed. Rep. of Germany | 112/260 |

*Primary Examiner*—Werner H. Schroeder
*Assistant Examiner*—Andrew M. Falik
*Attorney, Agent, or Firm*—Anthony J. Casella; Gerald E. Hespos

[57] ABSTRACT

A sewing machine with an articulated table is provided to facilitate the proper positioning and removal of workpieces. The drive shaft disposed under the table also is articulated to rotate with a portion of the table. An alignment piston is provided to securely align the drive shaft prior to any articulation thereof. An articulation piston is provided to positively move the table through its range of articulation. A locking piston also is provided to lock the table into its nonarticulated condition. The various piston members are preferably controlled by a common unit to ensure coordinated action.

16 Claims, 6 Drawing Figures

SEWING MACHINE WITH ARTICULATED TABLE ASSEMBLY

BACKGROUND OF THE INVENTION

Industrial sewing machines often are used to attach one or more layers of material to a non-planar member. For example, a top layer, a layer of padding and backing layer may simultaneously be sewn onto a non-planar structure such as a portion of a chair or automobile seat. In many instances the non-planar base structure will include a plurality of intersecting surfaces which define at least a partial enclosure.

Sewing operations on non-planar structures, such as automobile seats, typically require a sewing machine with a pedestal extending from the sewing machine table directly beneath the needle. The pedestal includes the mechanical shuttle members which interact with the thread carried by the needle to create the stitches. Thus, in the prior art sewing machine, the non-planar structure can effectively be mounted upon the pedestal and moved relative thereto to carryout the necessary sewing operations. More particularly as the surface of the structure to be sewn is mounted on the pedestal of the prior art sewing machine, the various intersecting surfaces of the structure will extend downwardly from the pedestal toward the table of the sewing machine.

Although the above described prior art industrial sewing machine facilitates the sewing of fabrics and such onto non-planar articles, this prior art sewing machine does not facilitate the initial mounting of the non-planar structure onto the sewing machine or the removal of the structure therefrom. More particularly, the above described prior art industrial sewing machine operates in much the same manner as a standard sewing machine in that the needles are merely retracted slightly upwardly to place the article or structure to be sewn into its proper position with respect to the needle. Although this standard operation is quite acceptable for planar articles, this prior art construction makes the initial mounting and ultimate removal of a non-planar structure extremely difficult. Specifically, it is necessary for the operator of the above described industrial sewing machine to simultaneously advance and rotate the structure to be sewn through several planes. These complex movements to mount the structure to be sewn must be carried out very carefully because of the presence of the sewing machine needles. More particularly a sudden movement could injure the operator, damage the workpiece and/or break the needle. As a result of these constraints a large proportion of an operator's time with prior art sewing machines has been spent positioning the object to be sewn and then removing it from the machine.

In view of the above it is an object of the subject invention to provide a sewing machine that can more easily accept non-planar articles or structures to be sewn.

It is another object of the subject invention to provide a sewing machine that can reduce the time alloted to positioning an article or structure to be sewn.

It is a further object of the subject invention to provide an industrial sewing machine on which the space between the sewing machine arm and the portion of the table on which the workpiece is placed can be increased.

It is an additional object of the subject invention to provide a sewing machine wherein a portion of the table can be articulated away from the needles for mounting of an object to be sewn, yet wherein the sewing machine is extremely sturdy to enable precise sewing operations.

SUMMARY OF THE INVENTION

The subject invention is directed to an industrial sewing machine on which the portion of the sewing machine table with which the needles interact is articulated with respect to the remainder of the table. Briefly, the known industrial sewing machine includes an upstanding support mounted to the table and an arm extending therefrom generally parallel to the table. The support must be securely connected to both the arm and the table to prevent unintended movements of the arm relative to the table, and thereby ensure accurate sewing. The arm is the portion of the sewing machine in which the needle assembly is mounted. The arm further includes associated drive shafts and gears which operate the needle assembly. The drive shafts and gears are in communication with a motor which provides the necessary power for the sewing machine.

The table also houses at least one shaft which operates the shuttle members which interact with the needle to create a secure interengagement of threads. A pedestal can extend from the table generally in line with the needle assembly. The pedestal houses the shuttle members which interact with the needle as explained above. The pedestal also defines the portion of the sewing machine on which the workpiece is supported. In certain instances, as explained previously, the workpiece will define a non-planar structure. In these instances the portion of the workpiece that is being sewn will lie between the needle assembly and the pedestal, while remaining portions of the workpiece will extend either downwardly toward the table or upwardly generally toward the arm.

To facilitate the initial positioning of the workpiece between the pedestal and the needle, and to facilitate the eventual removal of the workpiece, the portion of the table adjacent the pedestal and the portion of the drive shaft mounted therein are articulated with respect to the remainder of the table. More particularly, the table is hinged intermediate the pedestal and the support extending from the table to the arm. This hinge enables the table to rotate from a first position where it is substantially precisely aligned with the remainder of the table, to a second position where it is between approximately 15° and 45° out of the plane of the remainder of the table. This articulation of the portion of the table adjacent the pedestal enables a non-planar workpiece to be positioned over the pedestal and thus intermediate the needle assembly and the mechanical shuttle members included within the pedestal. After the workpiece has been properly positioned on the pedestal, the table can be rotated back into its position where it is substantially precisely in its original plane parallel to the arm and perpendicular to the needle assembly.

As noted above, the table includes a drive shaft or a plurality of parallel drive shafts which operate the shuttle mechanisms in the pedestal to enable a proper interengagement of the various threads being sewn into the workpiece. The above described articulation of the table cannot be carried out without a corresponding articulation of each drive shaft. Consequently a coupling is provided in each drive shaft which enables an articulation of the portion of each drive shaft adjacent the articulated portion of the table. More particularly the supported portion of each drive shaft terminates in a generally fork-shaped coupling member having spaced apart parallel plates. The opposed articulated portion of each drive shaft terminates in a coupling member having a single generally planar plate which is slideably engaged between the spaced apart plates of the fork-shaped coupling member. As a result of this connection, the articulated portion of each drive shaft may rotate through the plane parallel to the three plates of the coupling. Furthermore, during this rotational movement, a certain amount of slideable movement between the plate and the fork-shaped connector is possible.

When the articulated portion of a drive shaft is generally collinear with the remainder to the drive shaft, rotational movement of either member will be transmitted through their respective coupling members causing the other drive shaft member to rotate as well. Therefore, as a result, an entire drive shaft including the articulated portion thereof can be rotated by the motor of the sewing machine when the two members are collinear. However, if a drive shaft is not rotating the articulated portion thereof can be articulated with respect to the supported portion through a plane generally parallel to the plates of the coupling members.

The proper operation of the subject articulated sewing machine requires that the articulated portion of the table and the articulated portion of each drive shaft move about axes that are either collinear or parallel. Stated differently, the planar plates of the coupling members must be perpendicularly aligned with respect to the table for the articulated portions of the table and drive shaft to articulate properly with respect to one another. The approximate desired alignment of the single plate and fork-shaped coupling members can be obtained by using an appropriate synchronous motor that will stop at approximately the same position at all times. This synchronous motor can be appropriately geared such that each time the sewing machine stops operation, the plates of the coupling members will be approximately perpendicularly aligned with respect to the table. This alignment caused by the synchronous motor can only be approximate. A slight misalignment can damage either the connector members, a drive shaft or other members of the sewing machine. Furthermore, if the sewing machine was unintentionally started after the table has been articulated, an even greater damage to the connector members and a drive shaft will occur. Accordingly, an alignment means is provided to further assure that the articulated portion of the drive shaft is precisely positioned to hingedly move along with the articulated portion of the table.

The alignment means preferably includes a piston mounted adjacent each drive shaft. Each drive shaft accordingly is provided with a collar having a notch therein. The notch and the piston are aligned with respect to one another such that an extension of the piston into the notch will achieve the proper angular position of the drive shaft. The piston can be pneumatically operable and in communication with the sewing machine motor such that when the motor is stopped the piston will be pneumatically operated to extend into the notch in the collar. The notch and the head of the piston are appropriately tapered such that the movement of the piston can cause a slight angular rotation of the drive shaft such that the drive shaft assumes an essentially precise angular alignment for articulation of both the table and the drive shaft. This interengagement of the piston with the collar also insures that the associated drive shaft will not inadvertently become activated while the table is in its articulated condition. After the workpiece has been positioned or removed from the pedestal, the piston can again be operated to withdraw from the notch in the collar. Again, this operation can be performed as part of the on and off activation of the sewing machine.

A second electrical, mechanical, pneumatic or pneumatic means can be provided to positively move the articulated portion of the table and the drive shaft into their proper position for mounting or removing the workpiece. Preferably this means for moving the table is a hydraulic piston in communication with an electrical activator device.

DETAILED DESCRIPTION OF THE PREFERRED EMBODIMENT

Figure 1:
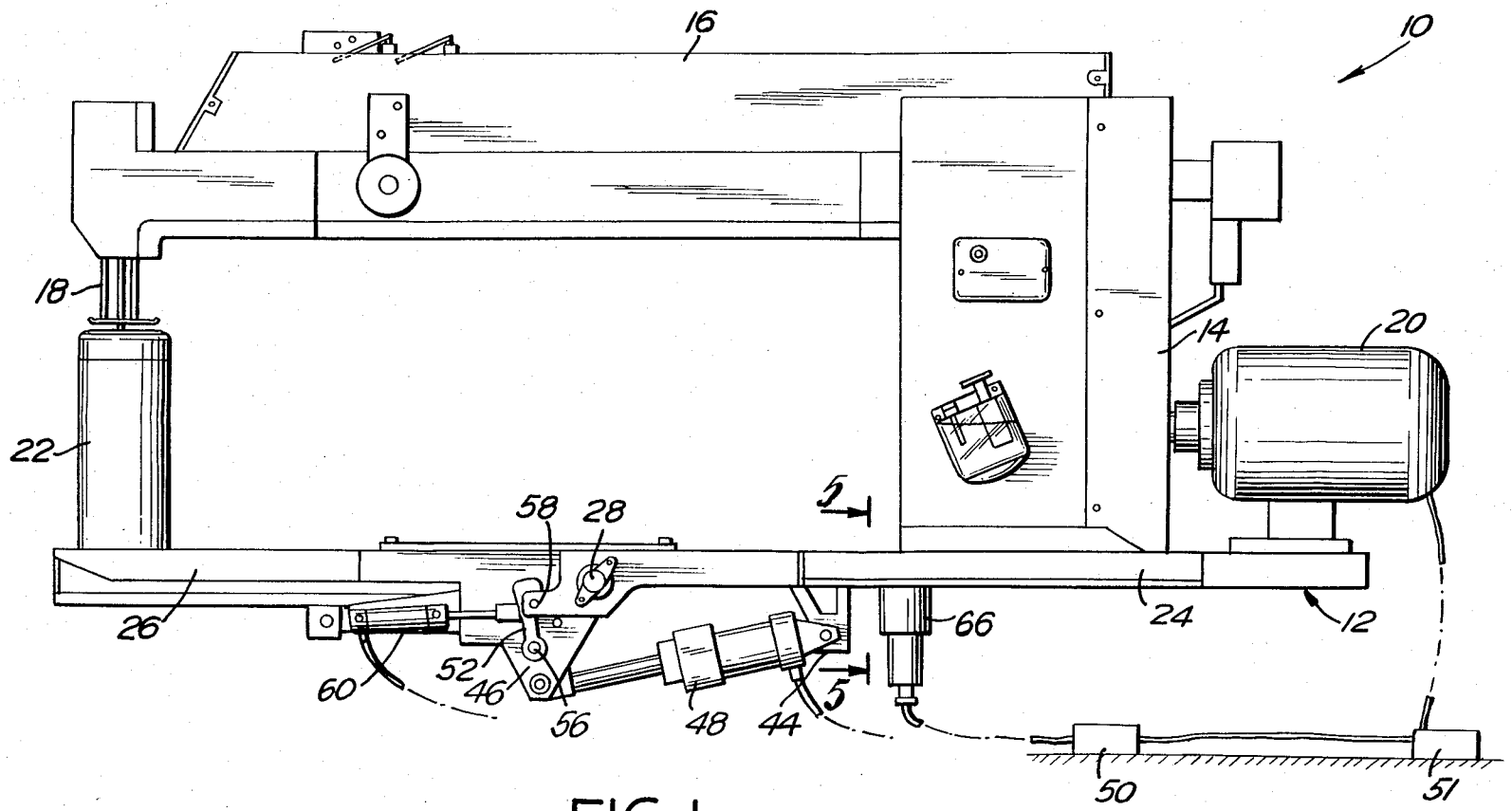
FIG. 1 is a front elevational view of the sewing machine of the subject invention.

The articulated sewing machine of the subject invention is indicated generally by the numeral 10 in FIG. 1. The sewing machine 10 includes a substantially planar table identified generally by the numeral 12. A support structure 14 is securely attached to the table 12 and extends generally perpendicularly therefrom. An arm 16 is securely attached to the end of support structure 14 opposite table 12. More particularly the arm 16 extends substantially parallel to the table 12. The support structure 14 and the arm 16 are sufficiently strong to prevent deflections of the arm 16 with respect to the table 12, thereby ensuring accurate sewing.

The arm 16 terminates at a needle assembly 18. The arm 16 further includes a drive shaft (not shown) which extends within the arm 16 and substantially the entire length thereof. The drive shaft is in communication with the needle assembly 18 and with motor 20. Thus, power from motor 20 is transmitted through the arm 16 to operate the needle assembly 18. Threads (not shown) also are interengaged with the needle assembly such that the operation of the needle assembly moves the threads into and out of the article or structure to be sewn in accordance with a preselected stitching pattern.

The table 12 includes a pedestal 22 which extends generally perpendicularly therefrom and is generally in line with the needle assembly 18. The pedestal 12 houses at least one spool of thread and the necessary shuttle mechanism for interengaging the thread in the pedestal with the thread carried by the needle assembly 18. The shuttle mechanism in the pedestal 22 enables the various arrays of thread to be interlocked with one another into the appropriate stitching pattern. The table 12 further includes a drive shaft, which is not shown in FIG. 1 but is shown in the remaining figures and described in greater detail below. The drive shaft in the table 12 is connected to both the shuttle mechanism in the pedestal 22 and to the motor 20. Thus, the operation of motor 20 causes a rotation of the drive shaft in table 12, which in turn operates the shuttle mechanisms in pedestal 22.

In operation, the article or structure to be sewn is mounted between the needle assembly 18 and the pedestal 22. The illustrated construction of sewing machine 10 is particularly effective for non-planar structures in that it provides sufficient room for surfaces intersecting the surface on which the sewing operation is to be performed.

To facilitate the initial positioning of the workpiece between the needle assembly 18 and the pedestal 22, the table 12 is provided with a stationary support portion 24 and an articulated portion 26. The articulated portion 26 is hingedly connected to the stationary portion 24 of table 12 at hinge connection 28, such that articulated portion 26 can rotate away from arm 16 as illustrated more clearly in FIGS. 2 and 3. The angular movement of the articulated portion 26, as defined by angle "A" in FIG. 3 preferably is between 15° and 45°. In the preferred embodiment, the articulated portion 26 is adpated to move through a maximum angle "A" of approximately 22°.

Figure 3:
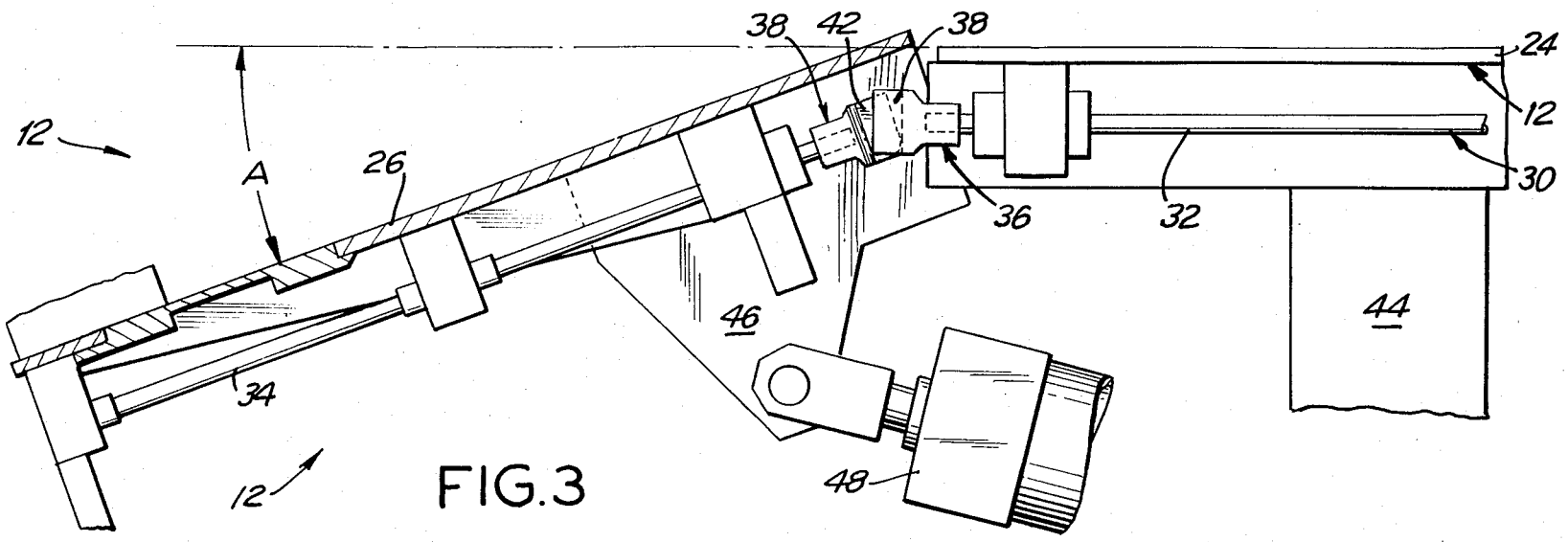
FIG. 3 is a cross-sectional view similar to FIG. 2 but showing the sewing machine in an articulated condition.
Figure 4:
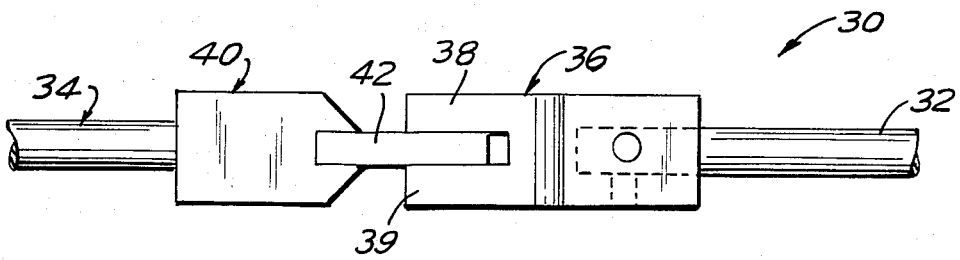
FIG. 4 is an elevational view taken along line 4—4 in FIG. 2.
Figure 5:
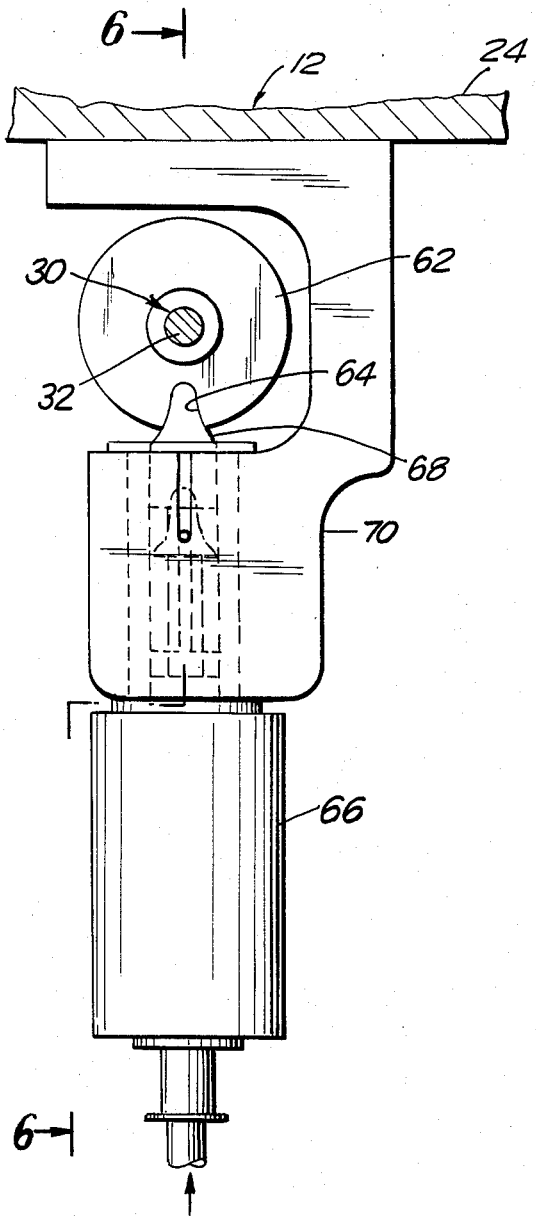
FIG. 5 is a cross-sectional view taken along line 5—5 in FIG. 1.
Figure 6:
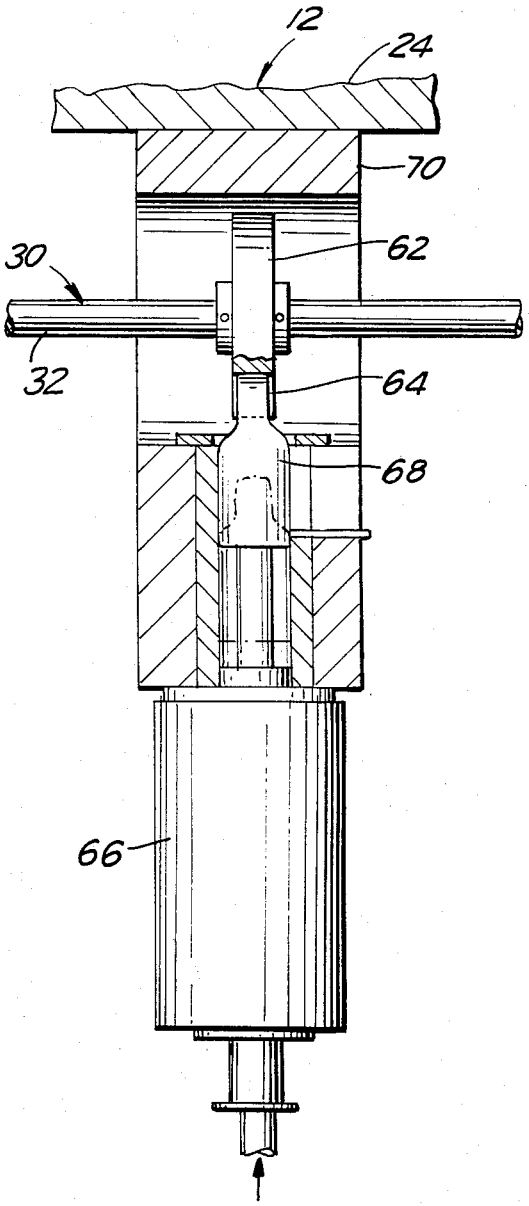
FIG. 6 is a cross-sectional view taken along line 6—6 in FIG. 5.

As noted above, and as shown in FIGS. 2 and 3, a drive shaft 30 extends entirely along the length of table 12. Logically, the drive shaft 30 must be able to articulate along with the table 12. To achieve this purpose, the drive shaft 30 includes a supported portion 32 and an articulated portion 34. The end of the supported portion 32 opposite the motor 20 terminates at a fork coupling member 36, as illustrated most clearly in FIGS. 2 through 4. More particularly, the fork coupling member 36 includes a pair of spaced apart parallel plate members 38 and 39 as shown best in FIG. 4. The end of the articulated portion 34 of drive shaft 30 opposite the pedestal 32 terminates with a coupling member 40, having a single plate 42 which is dimensioned to fit in sliding relationship intermediate the spaced apart parallel plate members 38 and 39 of the fork coupling member 36. This sliding interengagement of the coupling members 36 and 40 enables the articulated portion 34 of drive shaft 30 to hingedly move relative to the supported portion 32 thereof as illustrated most clearly in FIG. 3.

Efficient operation of the sewing machine 10 requires that the table 12 be locked into its planar condition during all sewing operations, and that the articulated movement of the table 12 be carried out easily by mechanical means upon the direction of the operator of sewing machine 10. To accomplish this, the support and articulated portions 24 and 26 of table 12 each include brackets 44 and 46 respectively. Hydraulic articulation piston 48 extends between and is pivotally mounted to the brackets 44 and 46. The brackets 44 and 46 are dimensioned such that the axis of articulation piston 48 is spaced from and generally perpendicular to the axis of hinge 28. The hydraulic articulation piston 48 is in communication with a hydraulic control unit shown schematically and indicated generally by the numeral 50 in FIG. 1. The hydraulic control unit 50 is of a type known to the person skilled in this art and may include electronically operated valves and a source of pressurized hydraulic fluid. Additionally, the hydraulic control unit 50 is of a type that can be readily activated by the operator of sewing machine 10 through electronic control unit 51 which also controls motor 20. Preferably the hydraulic control unit 50 and electronic control unit 51 cooperate to prevent the piston 48 from articulating the table 12 while the motor 20 is operating.

Figure 2:
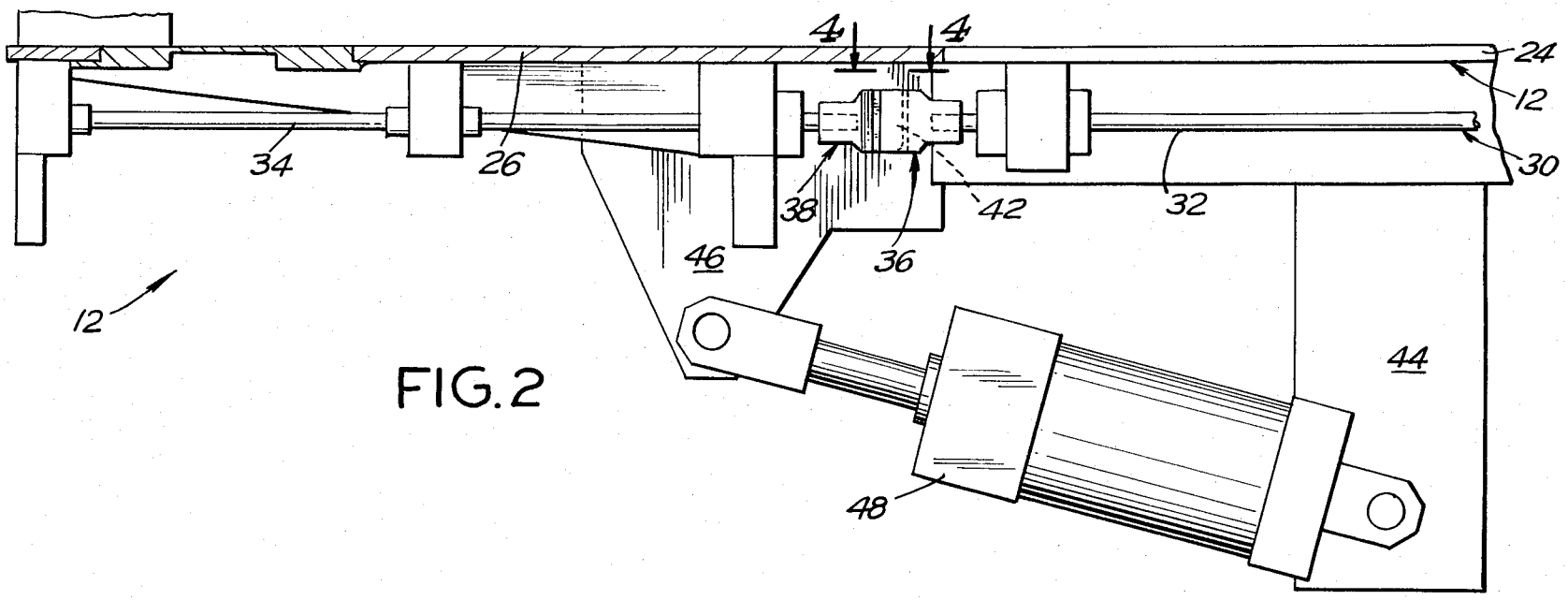
FIG. 2 is a cross-sectional view of the sewing machine of the subject invention.

To further prevent an unintended articulation of table 12, and to insure proper alignment of the articulated portion 26 of table 12 with respect to the supported portion 24 of table 12, a locking latch 52 is provided. More particularly the locking latch 52 is rotatably mounted to the bracket 46 at point 56. The supported portion 24 is provided with a locking bar 58 which is disposed and dimensioned to be engaged by the latch 52 when the table 12 is in its unarticulated condition as shown in FIGS. 1 and 2. A locking hydraulic piston 60 is mounted to the articulated portion 26 of table 12 and is further connected to the latch 52. The locking piston 26 is operative to move the latch 52 into its locked condition with respect to bar 58. Thus, the articulated portion 26 of table 12 is securely locked in its unarticulated condition when the hydraulic locking piston is in its extended condition. The hydraulic locking piston, is in communication with hydraulic control unit 50. Thus, upon an appropriate signal from the electronic control unit 51 and the hydraulic control unit 50 the hydraulic locking piston 60 will withdraw, thereby disconnecting the latch 52 from the rod 58 and enabling the articulated portion 26 of table 12 to rotate with respect to the support portion 24. In the preferred embodiment the movement of the locking piston 60 and the articulation piston 48 are coordinated such that the locking piston will first disengage the latch 52, and then the articulation piston 48 will cause table 12 to be advanced into its articulated condition. The reverse steps will be carried out by pistons 48 and 60 after the workpiece has been properly positioned on pedestal 22.

The articulation of table 12 requires that the parallel plate members 38 and 39 of fork coupling member 36 be aligned substantially precisely perpendicular to the axis of rotation of the articulated portion 26 with respect to the support portion 24. The required alignment of the fork coupling 36 can be approximately attained by insuring that motor 20 is of synchronous construction, such that it stops at approximately the same location each time. The gears intermediate the motor 20 and the drive shaft 30 thus can be set up such that the parallel plate members 38 and 39 are aligned substantially perpendicular to the axis of rotation of the articulated portion 26 each time motor 20 stops. Although the synchronous construction of motor 20 achieves an approximate desired positioning of the fork coupling 36, a very precise positioning is required for the articulated portion 34 of drive shaft 30 to rotate with respect to the supported portion 32 thereof. More particularly, the coupling members 36 and 40 or the portions of shaft 30 connected thereto can be significantly damaged if the fork coupling member 36 is even slightly misaligned. Furthermore, any unintended rotation of shaft 30 while in its articulated condition can seriously damage shaft 30 or the coupling members 36 and 40.

To insure the proper precise alignment of the fork coupling member 36, a notched collar 62 is securely mounted to the support portion 32 of drive shaft 30. More particularly the collar 62 includes a generally arcuate notch 64 extending radially into the collar 62. The notch 64 is positioned on collar 62 such that a radius extending centrally through notch 64 would be precisely parallel to the plane of plates 38 and 39 of the fork coupling member 36.

An alignment piston 66 is mounted to the supported portion 24 of table 12. More particularly the alignment piston 66 is hydraulically operated and includes an alignment head 68 the end of which has substantially the identical configuration as the notch 64. The locking piston 66 is securely mounted to the supported portion 24 of table 12 by bracket 70 such that the movement of the alignment head 68 of piston 66 is substantially precisely perpendicular to the plane of support portion 24 of table 12. Furthermore, the alignment piston 66 is positioned with respect to collar 62 such that in the extended position of piston 66 the alignment head 68 advances into the notch 64 thereby insuring a precise alignment of collar 62, drive shaft 30, and the forked coupling member 36. The arcuate configuration of the notch 64 and the alignment head 68 facilitate the interengagement of the two members. More particularly if the collar 62 is slightly out of line, the movement of the arcuate alignment head 68 into the arcuate notch 64 will cause an appropriate minor rotation of the collar 62 and drive shaft 30 to achieve the proper precise alignment of the drive shaft 30. Furthermore the secure positioning of the alignment head 68 in the notch 64 substantially prevents any unintended rotation of the drive shaft 30.

The alignment piston 66 also is in communication with the hydraulic control unit 50. The hydraulic control unit 50 is operative to advance the alignment head 68 into the notch 64 prior to unlocking latch 52 or rotating the articulated portion 26 of table 12 as described above. Consequently the drive shaft 30 is assured of being in the precise proper angular position prior to advancing table 12 into its articulated condition. It also is preferred that the control unit be in communication with the motor 20 such that the motor 20 cannot be operated while the locking piston engages the collar 62.

The complete operation of the sewing machine 10 would proceed generally as follows. The operator initially would have the motor 20 in the off mode and would be prepared to mount a workpiece, such as a non-planar automobile seat or other non-planar structure. In this off condition of motor 20 the locking member 68 of locking piston 60 would be advanced into notch 64 of collar 62, thereby ensuring the precise desired alignment of drive shaft 30. The operator of machine 10 then would trigger the articulation of table 12. This triggering typically would be carried out through the electronic control unit 51 and the hydraulic control unit 50. As a result of this triggering the locking piston 60 would cause latch 52 to become disengaged. Subsequently the articulation piston 48 would positively move the articulated portion 26 of table 12 about its hinge 28 and away from the arm 16. This movement of articulated portion 26 preferably would extend through an angle of approximately 22°. The operator of machine 10 thus would be provided with ample room for mounting the workpiece intermediate the pedestal 22 and the needle assembly 18. The operator then would trigger the return of table 12 to its completely planar condition. This would be accomplished through the electronic control unit 51 and the hydraulic control unit 50. More particularly the articulation piston 48 would advance the articulated portion 26 of table 12 into a condition where it is substantially precisely in line with the support portion 24 thereof. The locking piston 60 then would advance the latch 52 to engage the rod 58 thereby securely retaining table 12 in its completely planar condition. Finally, the locking member 68 of piston 66 would withdraw enabling the drive shaft to be rotated to perform a sewing operation.

In summary, a sewing machine is provided with an articulated table. To achieve the articulation of the table, the drive shaft located under the table also is articulated. This movement of the table facilitates the positioning and removal of a workpiece to be sewn by the machine. The articulation of the table is positively carried out by mechanical, hydraulic, and/or electrical means. To insure proper alignment of the drive shaft prior to articulation of the table a synchronous motor is provided to power the sewing machine. Additionally an alignment piston is provided which advances into a collar mounted on the drive shaft to precisely align the drive shaft thereby enabling its articulation. A locking piston also is provided to lock the table into its planar condition.

While the invention has been described and illustrated with respect to certain preferred embodiments, it is obvious that various modifications can be made therein without departing from the spirit of the present invention which should be limited only by the scope of the appended claims.

What is claimed is:

1. A sewing machine comprising:

a power means for operating said sewing machine;

an arm member including a needle assembly for performing a sewing operation and a drive means in communication with said needle assembly and said power source for enabling the operation of said needle assembly;

a support structure connected to and supporting said arm member; and a table including a support portion and an articulated portion, said support portion being securely connected to said support structure and disposed in fixed relationship to said arm, said articulated portion being hingedly connected to said support portion and rotatable relative thereto, said table further including a drive shaft means in communication with said power source, said drive shaft means including a supported portion generally adjacent to the support portion of said table and an articulated portion generally adjacent the articulated portion of said table, said articulated portion of said drive shaft means being hingedly movable with respect to said support portion thereof such that the articulated portions of said table and said drive shaft means can hingedly move with respect to the support portion of said table.

2. A sewing machine as in claim 1 further including articulation means for hingedly moving said articulated portions of said table and said drive shaft means relative to the support portion of said table.

3. A sewing machine as in claim 2 further comprising a locking means for locking the articulated portion of said table into substantially the same plane as the support portion thereof.

4. A sewing machine as in claim 3 wherein the locking means comprises a locking piston and a latch rotatably mounted to said table and connected to said locking piston, said latch being moveable into a locked condition wherein said latch prevents hinged movement of the articulated portion of said table relative to said support portion thereof.

5. A sewing machine as in claim 2 further comprising means for aligning said drive shaft means to enable the articulation thereof.

6. A sewing machine as in claim 5 wherein said drive shaft means comprises a drive shaft and wherein the means for aligning said drive shaft includes a collar fixedly mounted thereto, said collar being provided with a generally radially extending notch, said means for aligning said drive shaft further including an alignment piston operative to extend an alignment head into said notch in said collar to precisely align said drive shaft.

7. A sewing machine as in claim 2 wherein said articulation means comprises an articulation piston for positively moving the articulated portion of said table from a first position where it is substantially aligned with the support portion of said table to a second position where said articulated portion of said table is angularly disposed with respect to said support portion thereof.

8. A sewing machine as in claim 7 wherein the articulated portion of said table has a range of hinged movement of between approximately 15° and approximately 45°.

9. A sewing machine as in claim 8 wherein the articulated portion of said table has a range of movement of approximately 22°.

10. A sewing machine as in claim 1 wherein the drive shaft means comprises a drive shaft and wherein the supported portion and the articulated portion of said drive shaft include first and second interengaged coupling members, the first coupling member defining a pair of spaced apart parallel plates, and the second coupling member defining a single plate slideably disposed between the spaced apart plates of the first coupling member.

11. An articulated table for a sewing machine having an arm and needle assembly, said table comprising a support portion to which said sewing machine arm and needle assembly are mounted and an articulated portion articulated to said support portion thereof and hingedly movable between a first position in substantially the same plane as said support portion of said table and a second position angularly rotated away from the needle assembly, said table further including an articulated drive shaft comprising a support portion disposed generally parallel to and adjacent the support portion of said table and an articulated portion coupled to said support portion of said drive shaft and disposed generally adjacent the articulated portion of the table, the coupling between the support and articulated portions of said drive shaft enabling said articulated portion of said drive shaft to hingedly move about said coupling relative to said support portion thereof, whereby the articulated portions of said table and said drive shaft can be selectively articulated away from the needle assembly of the sewing machine mounted on said table.

12. A table as in claim 11 further including means for hingedly moving the articulated portions of said table and said drive shaft relative to the support portions thereof.

13. A table as in claim 12 wherein said means comprises a hydraulic articulation piston.

14. A table as in claim 12 further comprising means for locking said table in its unarticulated condition.

15. A table as in claim 14 further including a control means, said control means being in communication with the articulation means and the locking means to control the sequential operation of said articulation means and said locking means relative to one another.

16. A table as in claim 11 wherein the coupling between the articulated and support portions of said drive shaft comprises a fork coupling member securely affixed to one of said articulated or support portions of said drive shaft, said fork coupling member comprising spaced apart parallel plate members, said coupling further including a single plate coupling member articulated to the other of said articulated or support portions of said drive shaft, said single plate coupling member comprising a plate slideably disposed intermediate the spaced apart parallel plates of said fork coupling member.

* * * * *